United States Patent [19]

Aricco

[11] 4,357,951

[45] Nov. 9, 1982

[54] FROSTING OR TIPPING CAP FOR VARYING INTENSITY OF TREATMENT

[76] Inventor: Ronald A. Aricco, Ste. 206, 17530 NW. 68th Ave., Miami, Fla. 33015

[21] Appl. No.: 815,819

[22] Filed: Jul. 15, 1977

[51] Int. Cl.[2] ..... A45D 19/18

[52] U.S. Cl. ..... 132/9

[58] Field of Search ..... 132/9, 7

[56] References Cited

U.S. PATENT DOCUMENTS

| | | | |
|---|---|---|---|
| 2,957,480 | 10/1960 | Widoff et al. | 132/7 |
| 3,270,753 | 9/1966 | Cook et al. | 132/9 |
| 3,390,689 | 7/1968 | Newman | 132/9 |

*Primary Examiner*—G. E. McNeill

*Attorney, Agent, or Firm*—Eugene F. Malin

[57] ABSTRACT

A hair frosting or tipping cap for accurately selecting a uniform distribution of particular locks of hair to be color treated (dye, bleach or tint) or any other treatment where a particular density of hair is desirable while shielding the remaining hair in order to achieve a desired intensity of hair to be treated. The device allows a person skilled or unskilled in the use of a frosting or tipping cap to achieve selective variable intensity of hair to be treated. The cap includes a plurality of hair receiving, puncturable areas forming apertures uniformly spaced about the cap surface and two or more indicia means such as color coding which are affixed in proximal relationship to particular apertures in preconceived patterns whereby the indicia means provide readily visible information to direct the user to select particular apertures through which locks of hairs are pulled out to achieve a particular desired level of intensity of color. Utilizing the color code indicia, for example, one particular color indicium could indicate light color for bleaching and only particular (predetermined) apertures having that color code would be utilized. The resilient cap body protects the unexposed hairs underneath the cap body from the bleach as does those apertures not in use. Greater frosting intensities can be achieved by selecting a different color code which is disposed next to a greater number of apertures or for lesser intensity by selecting a color code which is in proximal relationship to a lesser number of apertures, the color code scheme being uniformly applied to obtain a uniform aperture distribution.

3 Claims, 2 Drawing Figures

FROSTING OR TIPPING CAP FOR VARYING INTENSITY OF TREATMENT

BACKGROUND OF THE INVENTION

This invention relates generally to an improved frosting or tipping cap for use by professional beauticians, barbers or non-professional individuals to achieve a uniform selection of a desired intensity of the hair. In the past, a frosting or tipping cap has been shown which provides a plurality of hair lock receiving apertures disposed about a flexible cap body, such as U.S. Pat. No. 3,390,689, which has conventionally allowed for certain locks of hair to be selected without exposing hair under the cap to the treatment. Some people desired to have a larger number of tinted hair locks in proportion to the remaining unfrosted hair for providing different aesthetic appearances. One of the problems of using such caps is that it is difficult (especially for a non-professional) to determine which apertures to employ for a particular desired frosting intensity.

A frosting is accomplished by pulling locks of hair through the cap apertures and applying a bleach or other tinting material to the exposed hair to achieve the color, streaked or frosted appearance.

With the use of the instant invention, the non-professional or professional can frost anyone's hair to a desired uniform intensity by utilizing color code indicia in proximal relationship to the cap apertures during the application.

BRIEF DESCRIPTION OF THE INVENTION

A frosting or tipping cap having a flexible body shaped to fit over the top portion of the human head, the cap body having a plurality of uniformly disposed weakened areas to be punctured forming apertures thereabout. The body of the cap includes at least a first and second indicia color code disposed in proximal relationship to different predetermined apertures in uniform patterns but different densities such that the first indicia means is disposed next to a specific number of apertures (uniformly) and the second indicia means is uniformly disposed next to a greater or lesser number of apertures about the cap in accordance with a particular intensity plan. In one embodiment, the indicia are color coded such that particular colors are applied about the various apertures in the cap to indicate those apertures to be used for varying degrees of intensity for selection of hair to achieve the desired treatment.

In operation, a crochet needle (or other elongated instrument) is utilized before the cap is applied to the head to puncture the weakened areas forming apertures and to pull strands of hair through each selected aperture. Particular weakened areas for forming apertures are selected based on a particular color code which has been predetermined for the treatment intensity level desired. Once the color code has been selected and particular strands of hairs pulled through (exposing them above the protective cap) a bleach or other hair tint or dye is applied.

It is an object of this invention to provide an improved hair treatment cap to achieve variable treatment intensity based on a predetermined color code related to apertures in the cap.

It is another object of this invention to allow any individual, professional or non-professional, to achieve uniform treatment of the hair using a color coded indicia representative of varying degrees of intensity.

In accordance with these and other objects which will be apparent hereinafter, the instant invention will now be described with particular reference to the accompanying drawings.

PREFERRED EMBODIMENT OF THE INVENTION

Figure 1:
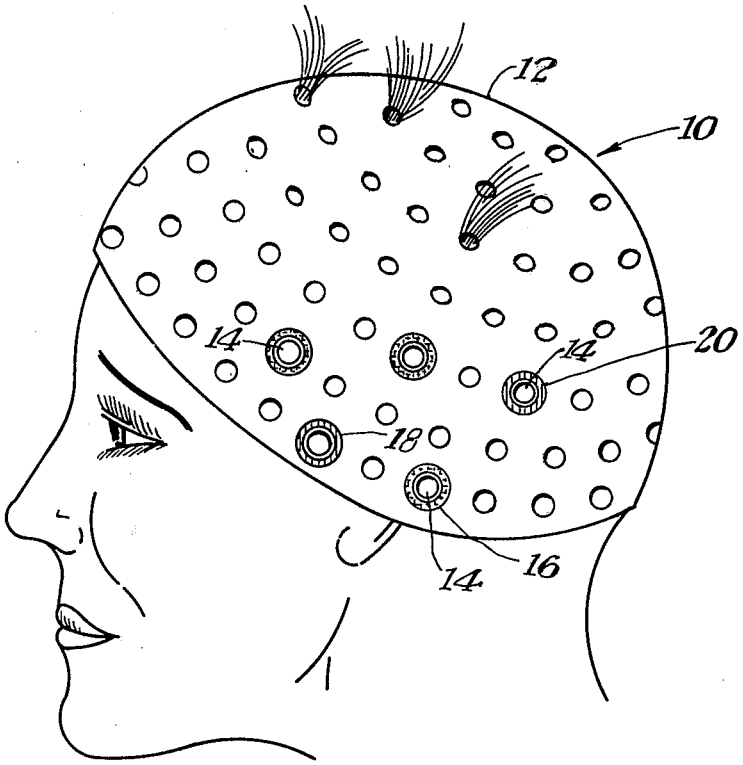
FIG. 1 shows a perspective view of the instant invention as utilized on a human head.

Referring now to FIG. 1, the instant invention is shown generally at 10 comprised of a flexible, head conforming cap 12 which is substantially hemispherical in shape and comprised of a thin rubber or other synthetic, flexible material which is capable of being fitted about the hair growing areas of a human head. The cap 12 includes a plurality of uniformly distributed areas for forming apertures 14 disposed through the cap body. Each aperture area 14 has associated therewith a color coded ring (not shown on drawing at all apertures for clarity) such as color rings 16, 18 or 20 which identify a particular aperture relative to the overall intensity of hair to be treated desired by the operator. In essence one particular color represents a particular uniform aperture density pattern, the aperture density patterns being different for different colors. The indicia or color may be applied either by permanent paint or any other conventional means to identify each aperture in accordance with the predetermined intensity scheme. The indicia code is applied uniformly such that should one select a particular color in combination with other colors there will be a uniform application of the treatment and variable degrees of intensity depending on the particular color or colors selected. Each color is correlated to a specific treatment intensity such as light, medium and heavy as desired.

To utilize the device, the operator determines the intensity level of the treatment desired, selecting from a color code or other indicia means particular color apertures distributed uniformly about the cap to achieve the intensity desired. Before being placed on one's head, the cap selected aperture areas are punctured with a crochet needle. For example, if green indicated a light treatment, the operator would select those aperture areas having green indicia disposed thereabout. The operator places the cap over the head which covers the hair of the head. The flexible material of the cap 12 conforms to the shape of a particular head. The operator then utilizes the area forming an aperture and pulls strands of hairs through only those apertures with the green circles. After the selected locks of hair have been pulled through the selected apertures, which is accomplished with a crochet needle (or other similar instrument), the locks exposed are then treated in accordance with the operators intent—dye, tint or bleach.

Figure 2:
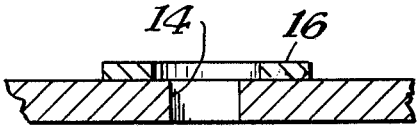
FIG. 2 shows a fragmentary cutaway side elevational view of a portion of the cap body and an aperture disposed therein.

FIG. 2 shows a typical aperture 14 disposed in the body 12 with one example of an indicia such as color ring 16 disposed about the aperture.

Various color codes or other indicia can be employed in proximal relationship to the apertures to achieve the purpose of the invention. For example, one color code may be the use of a combination of colors so that a heavy degree of streaking may be indicated by particular combinations of colors which have been predetermined in accordance with an intensity plan.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A hair treatment cap useful for selecting locks of human hair in a predetermined uniform density pattern and for treating the selected locks to achieve a desired treatment intensity, the cap providing shielding to the unselected remaining hair from the treatment material comprising:

a flexible sheet for covering the upper portion of a human head, said flexible sheet having a first group of areas for forming apertures uniformly distributed about the sheet in a uniform pattern, and a second group of areas for forming apertures arranged in accordance with a uniform pattern, said first and second groups of apertures having a different number of apertures; and indicia means disposed on said sheet in proximal relationship to said first and second groups of areas for forming apertures for distinguishing said first group areas from said second group of areas.

2. A hair treatment cap, as in claim 1, wherein:

said indicia means includes a first indicia means disposed in proximal relationship to said first group of areas and a second different indicia means distinguishable from said first indicia means disposed about said second group of areas.

3. A hair treatment cap, as in claim 2, wherein:

said first indicia means includes a first colored area and said second indicia means includes a second colored area, said first and second colored areas being different.

* * * * *